US005905481A

United States Patent [19]

Takaya

[11] Patent Number: 5,905,481

[45] Date of Patent: May 18, 1999

[54] RADIO PAGING RECEIVER WITH DOT MATRIX DISPLAY AND METHOD OF CONTROLLING THE SAME

[75] Inventor: Kei Takaya, Shizuoka, Japan

[73] Assignee: NEC Corporation, Tokyo, Japan

[21] Appl. No.: 08/744,767

[22] Filed: Nov. 6, 1996

[30] Foreign Application Priority Data

Nov. 13, 1995 [JP] Japan ..... 7-294090

[51] Int. Cl.[6] ..... G09G 3/20; G08B 5/22

[52] U.S. Cl. ..... 345/55; 345/189; 340/825.44; 359/143

[58] Field of Search ..... 345/55, 189; 340/825.31, 340/825.44, 825.69; 455/352, 151.2; 359/143; 369/30, 32, 33; 341/99, 176

[56] References Cited

U.S. PATENT DOCUMENTS

| | | | |
|---|---|---|---|
| 4,764,981 | 8/1988 | Miyahara et al. | 359/143 |
| 4,766,434 | 8/1988 | Matai et al. | 340/825.44 |
| 5,012,234 | 4/1991 | Dulaney et al. | 340/825.44 |
| 5,086,298 | 2/1992 | Katsu et al. | 340/825.69 |
| 5,105,189 | 4/1992 | Murai et al. | 340/825.44 |
| 5,177,478 | 1/1993 | Wagai et al. | 340/825.44 |
| 5,201,067 | 4/1993 | Grube et al. | 455/89 |
| 5,252,964 | 10/1993 | Tan et al. | 340/825.44 X |
| 5,304,991 | 4/1994 | Motegi | 340/825.44 |
| 5,365,226 | 11/1994 | Morishima | 340/825.44 |
| 5,386,251 | 1/1995 | Movshovich | 455/151.2 X |
| 5,440,559 | 8/1995 | Gaskill | 370/95.1 |
| 5,446,783 | 8/1995 | May | 379/59 |
| 5,489,894 | 2/1996 | Murray | 340/825.44 |
| 5,528,230 | 6/1996 | Kim | 340/825.31 |
| 5,546,077 | 8/1996 | Lipp et al. | 340/825.44 |
| 5,574,439 | 11/1996 | Miyashita | 340/825.44 |
| 5,675,395 | 10/1997 | Martin et al. | 348/734 |
| 5,694,119 | 12/1997 | Ono | 340/825.44 |
| 5,798,707 | 8/1998 | Camire | 340/825.44 |

*Primary Examiner*—Steven J. Saras
*Assistant Examiner*—Seth D. Vail
*Attorney, Agent, or Firm*—Scully, Scott, Murphy & Presser

[57] ABSTRACT

Infrared signal receiving and demodulating units 4, 5 are installed into radio paging receiver 10 having an illustration display function based on stored illustration data for displaying certain illustrations and a code signal sent from infrared remote control unit 20 through an infrared signal S1 are assigned to various illustrating functions and stored in memory 3, then a series of code signals corresponding to necessary illustrating functions are sent from infrared remote control unit 20 to display a certain illustration, and the illustration data of the displayed illustration are stored in memory 3 in order to answer display requests in received paging calls.

4 Claims, 3 Drawing Sheets

RADIO PAGING RECEIVER WITH DOT MATRIX DISPLAY AND METHOD OF CONTROLLING THE SAME

BACKGROUND OF THE INVENTION

1. Field of the Invention

The present invention relates to a radio paging receivers and more particularly to a radio paging receiver having an illustration display function and having a display screen for displaying an illustration in the form of a dot matrix.

2. Description of the Prior Art

Some radio paging receivers have a display screen for displaying an illustration in the form of a dot matrix. When a radio paging signal received by such a radio paging receiver includes a request for displaying an illustrations the radio paging receiver displays a given illustration in the form of a dot matrix on the display screen based on illustration data stored in a memory of the radio paging receiver. Illustration data can be stored into the memory using a number of switches, or two or more switches which must be pressed simultaneously.

A radio paging receiver which requires a number of switches for storing illustration data into its memory cannot be reduced in size because of a large installation space needed for the switches and is relatively expensive to manufacture due to the switches that are required.

Another radio paging receiver with two or more switches which must be pressed simultaneously for storing illustration data into its memory requires the user to perform a complex operation to store the illustration data.

SUMMARY OF THE INVENTION

It is therefore an object of the present invention to provide a radio paging receiver having an illustration display function in the form of a dot matrix which does not need a number of switches for storing illustration data and which does not require the user to perform a complex operation to store illustration data.

According to the present invention, there is provided a radio paging receiver having an illustration display function on a display screen in the form of a dot matrix based on illustration data stored in a memory means for displaying illustrations, comprising infrared signal receiving and demodulating means for receiving and demodulating an infrared signal which includes a plurality of code signals sent from an infrared remote control unit, and control means for assigning the code signals sent from the infrared remote control unit to various illustrating functions, and after storing the code signals into the memory means, receiving and demodulating an infrared signal from the infrared remote control unit which includes a series of code signals corresponding to the illustrating functions to display a certain illustration, displaying the certain illustration on the display screen according to the illustrating functions to which the series of code signals have been assigned, and storing the illustration data of the displayed illustration into the memory means.

According to another aspect of the present invention, there is provided a method of controlling a radio paging receiver having an illustration display function on a display screen in the form of a dot matrix based on illustration data stored in a memory means for displaying illustrations, the method comprising the steps of;

receiving and demodulating an infrared signal which includes code signals from an infrared remote control unit, assigning the code signals to various illustrating functions, storing the code signals into the memory means, receiving and demodulating an infrared signal which includes a series of code signals corresponding to the illustrating functions to display a certain illustration from the infrared remote control unit, displaying the certain illustration on the display screen according to the illustrating functions to which the series of code signals have been assigned, and storing the illustration data of the displayed illustration into the memory means.

The above and other objects, features, and advantages of the present invention will become apparent from the following description referring to the accompanying drawings which illustrate an example of a preferred embodiment of the present invention.

DETAILED DESCRIPTION OF THE PREFERRED EMBODIMENT

Figure 1:
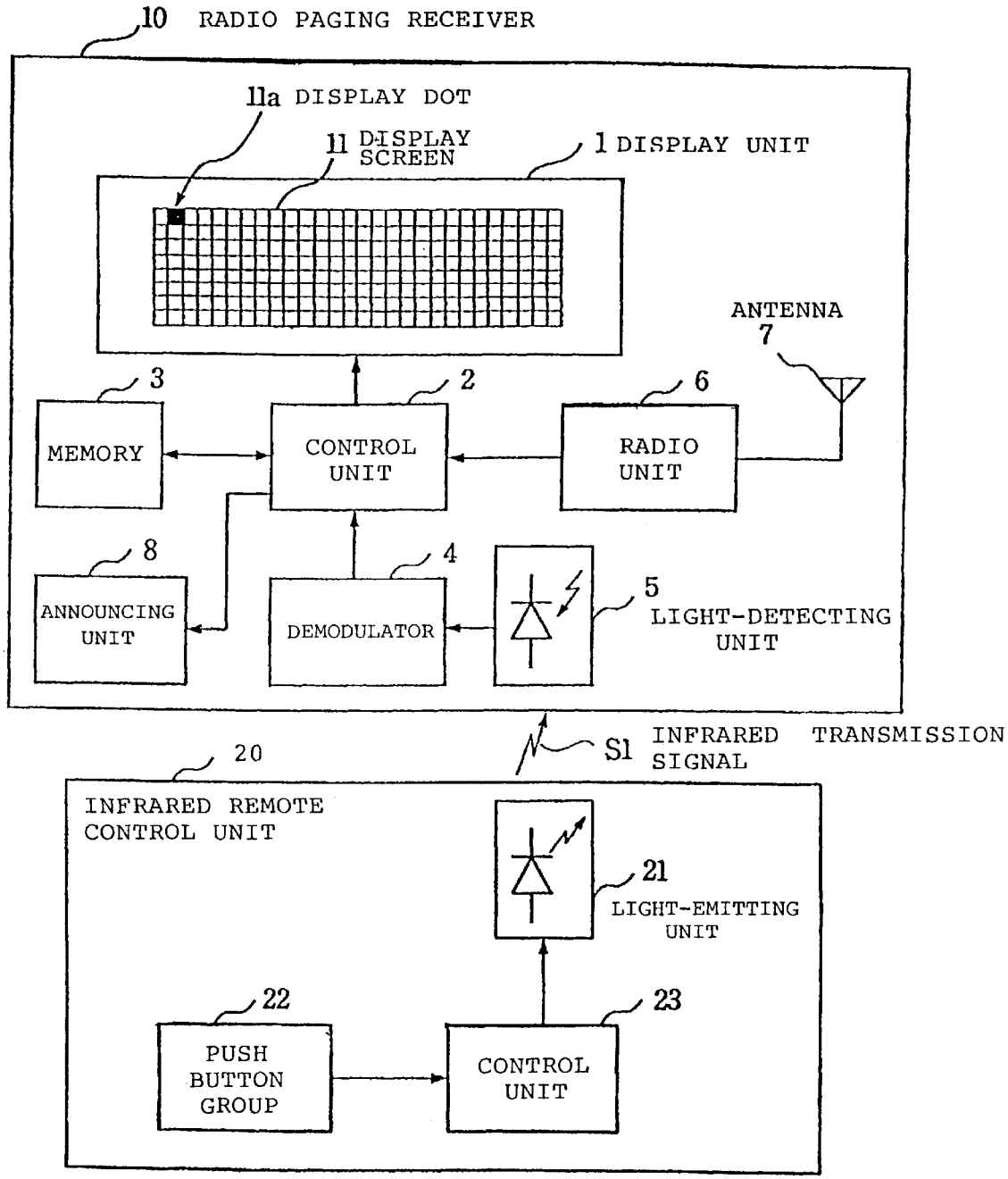
FIG. 1 is a block diagram of an embodiment of a radio paging receiver according to the present invention and an infrared remote control unit for storing illustration data into a memory of the radio paging receiver.

As shown in FIG. 1, radio paging receiver 10 according to the present invention has antenna 7 which receives a radio paging signal from a radio base station (not shown) of a paging system. The received radio paging signal is demodulated by radio unit 6 into a base band signal which is transmitted to control unit 2. Control unit 2 compares a paging number included in the base band signal with its own paging number stored in memory 3, and controls announcing unit 8 to announce the call if the compared paging numbers agree with each other. If the base band signal includes a message signal, then control unit 2 displays a message represented by the message signal on display screen 11, which comprises a dot matrix, of display unit 1. If the message signal comprises an illustration display request signal, then control unit 2 displays the illustration on display screen 11 based on illustration data stored in memory 3.

Illustration data are stored into memory 3 based on code signals transmitted through infrared transmission signal S1 which is transmitted from infrared remote control unit 20 shown in FIG. 1.

Infrared remote control unit 20 has a plurality of pushbuttons in pushbutton group 22. When one of the pushbuttons is pressed, control unit 23 sends a code signal corresponding to the pressed pushbutton to light-emitting unit 21. For example, when a first pushbutton is pressed, control unit 23 sends a code signal "001", when a second pushbutton is pressed, control unit 23 sends a code signal "010", when a third pushbutton is pressed, control unit 23 sends a code signal "011", when a fourth pushbutton is pressed, control unit 23 sends a code signal "100", and when a fifth pushbutton is pressed, control unit 23 sends a code signal "101". Light-emitting unit 21 converts the received code signal into an infrared transmission signal S1. The transmission signal S1 is received by light-detecting unit 5 of radio paging receiver 10. Infrared remote control unit 20 may be a command transmitter for setting functions for television receivers or personal computers (see, for example, Japanese laid-open patent publication No. 216616/93 entitled "Remote control for personal computers", Japanese patent laid-open publication No. 130206/89 entitled "Remote control device", and Japanese patent laid-open publication No. 131586/87 entitled "Remote control transmitter")

Light-detecting unit 5 in radio paging receiver 10 converts the received transmission signal S1 into an electric signal, and sends the electric signal to demodulator 4. Demodulator 4 demodulates the electric signal into a digital code signal that can be read by control unit 2, and delivers the code signal to control unit 20. The code signal is assigned as an illustration code signal to a illustrating function to display an illustration, and stored into memory 3 by control unit 2. For example, the code signal "001" is assigned to an illustrating function to move a display dot 11*a* on display screen 11 one dot downward, the code signal "010" to an illustrating function to move a display dot 11*a* on display screen 11 one dot upward, the code signal "011" to an illustrating function to move a display dot 11*a* on display screen 11 one dot to the right, the code signal "100" to an illustrating function to move a display dot 11*a* on display screen 11 one dot to the left, and the code signal "101" to an illustrating function to reverse a display dot 11*a* on display screen 11 between black and white.

After the code signals transmitted from infrared remote control unit 20 are assigned to the various illustrating functions and stored in memory 3 as illustration code signals, control unit 2 which receives a series of the illustration code signals through infrared signal S1 from infrared remote control unit 20 can retrieve the illustration code signals from memory 3 and display an illustration on display screen 11 according to the illustrating functions assigned to the illustration code signals. And control unit 2 stores illustration data of the displayed illustration into memory 3. A plurality of such illustration data may be stored in memory 3. After the illustration data are stored in memory 3, if the received radio paging signal having its own paging number includes an illustration display request for a certain illustration, control unit 2 can display on display unit 1 the illustration according to the illustration display request signal based on the related illustration data stored in memory 3.

An operation sequence for storing an illustration display code signal into memory 3 of radio paging receiver 10 will be described below with reference to FIG. 2.

Figure 2:
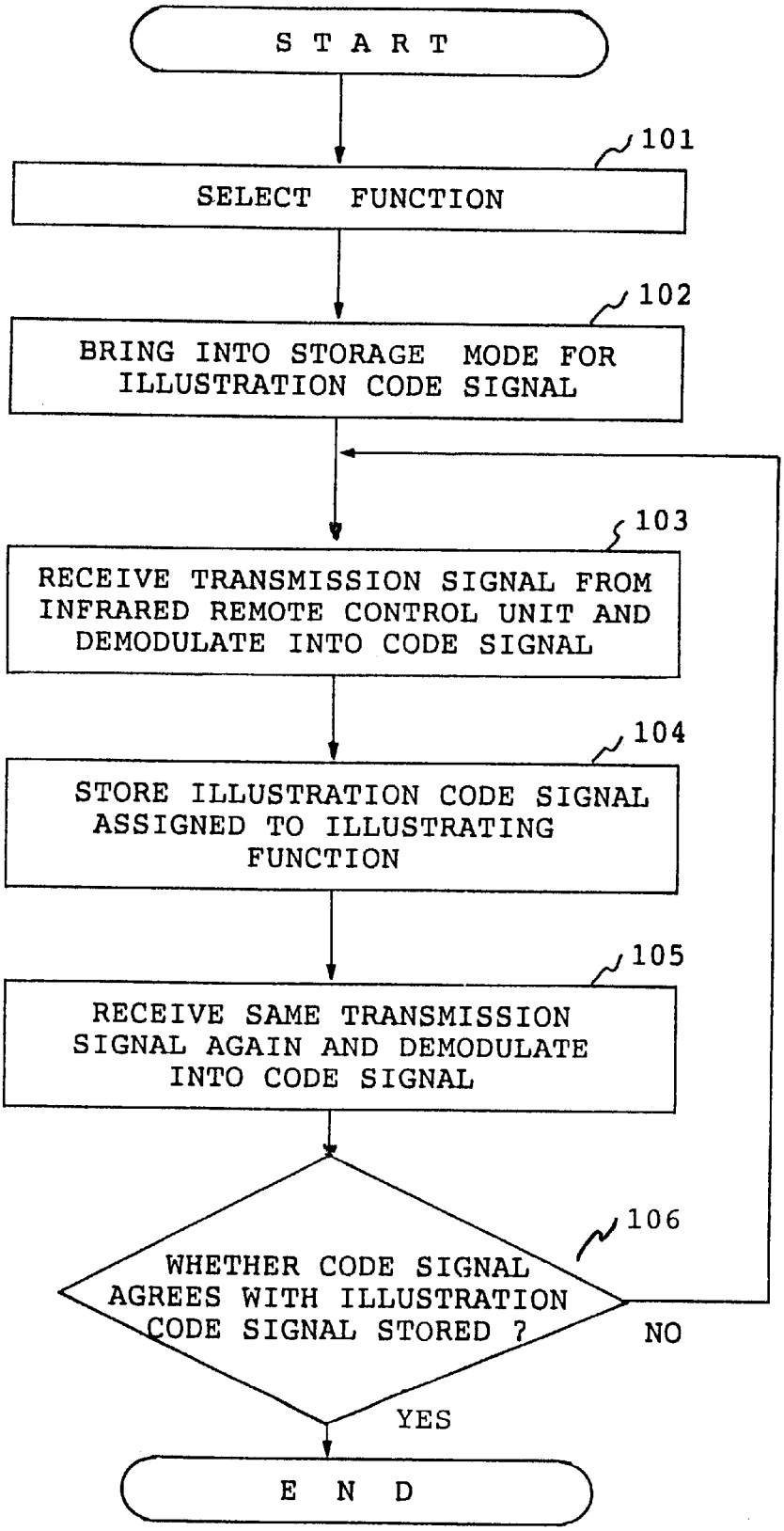
FIG. 2 is a flowchart of an operation sequence for storing an illustration code signal into the memory of the radio paging receiver shown in FIG. 1.

As shown in FIG. 2, the user of radio paging receiver 10 presses a mode setting switch (not shown) on radio paging receiver 10 to select a function in step 101, and brings radio paging receiver 10 into a storage mode for storing illustration code signals in step 102. The mode setting switch may double as another function setting switch. Then, the user presses one of the pushbuttons, e.g., a first pushbutton of pushbutton group 22 of infrared remote control unit 20 to start setting a first illustrating function, transmitting an infrared transmission signal S1 including a code signal to light-detecting unit 5 of radio paging receiver 10. Light-detecting unit 5 receives the infrared transmission signal S1 and demodulator 4 demodulates the signal from light-detecting unit 5 into a digital code signal, and delivers the code signal to control unit 2 in step 103. Control unit 2 assigns the code signal to a first illustrating function, and stores it as a first illustration code signal into an illustration code signal storage area in memory 3 in step 104. Then, in order to determine whether the illustration code signal stored in memory 3 is proper or not, the user presses the same pushbutton again on infrared remote control unit 20, and control unit 2 receives the code signal again in step 105.

After step 105, control unit 2 compares the received signal with the illustration code signal stored in memory 3 in step 106. If the compared signals agree with each other (YES in step 106), then the process of storing the illustration code signal into memory 3 is finished. As a result, the illustration code signal corresponding to the first illustrating function is stored in memory 3. If the compared signals do not agree with each other (NO in step 106), then the illustration code signal stored in memory 3 is erased, and step 103 and following steps are executed again.

After step 106, the user of the selective radio paging receiver 10 repeats steps 103 through 106, and presses the second through fifth pushbuttons twice to store illustration code signals corresponding to respective illustrating functions into memory 3. Thereafter, when control unit 2 sends the illustration code signals to display unit 1, display unit 1 displays an illustration according to the illustrating functions corresponding to the illustration code signals. When the storage of all illustration code signals is completed, the user of selective radio paging receiver 10 presses the mode setting switch to finish the storage mode for storing illustration code signals.

Figure 3:
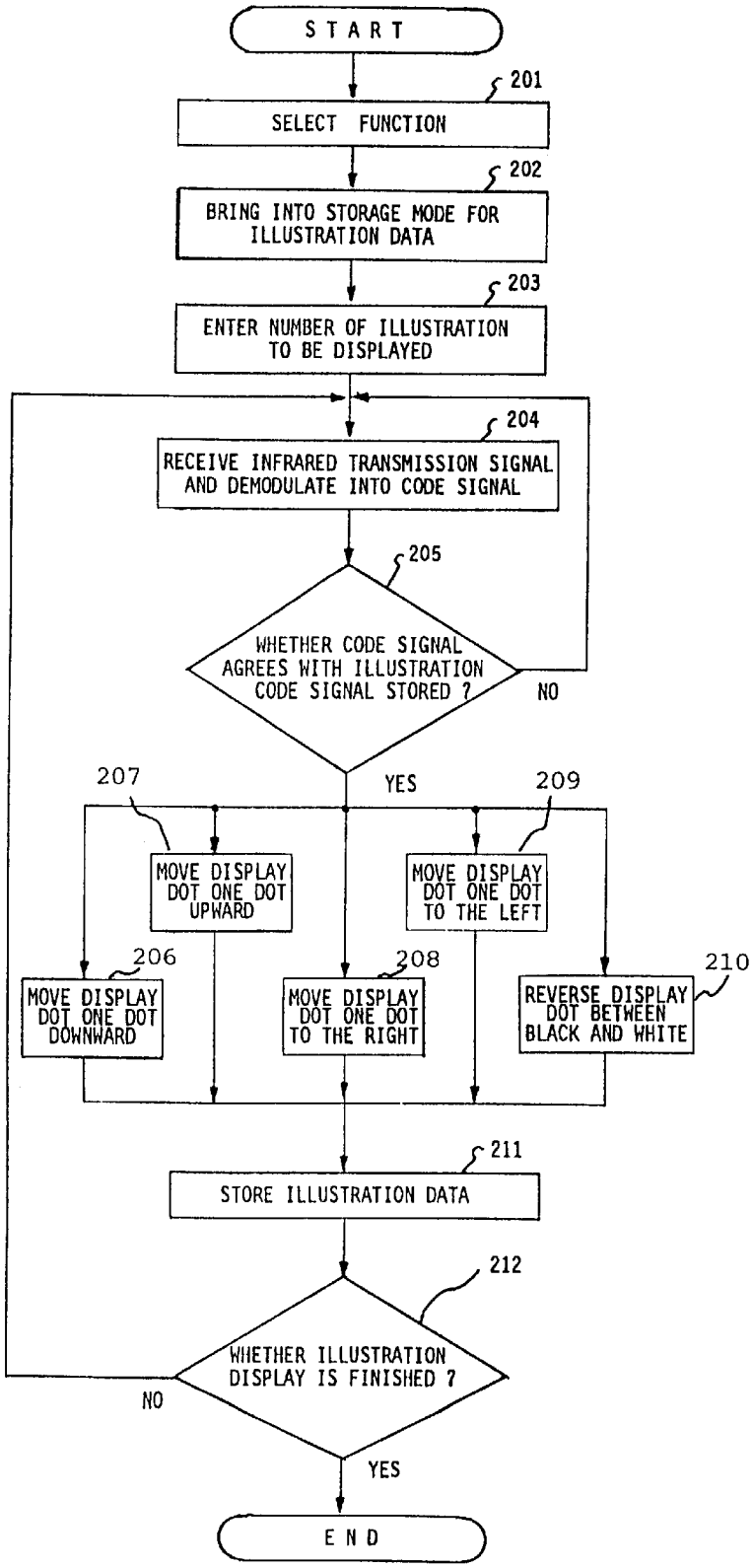
FIG. 3 is a flowchart of an operation sequence for storing illustration data into the memory of the radio paging receiver shown in FIG. 1.

After the operation sequence shown in FIG. 2, an operation sequence for storing illustration data into memory 3 of radio paging receiver 10 is carried out as shown in FIG. 3.

As shown in FIG. 3, the user of radio paging receiver 10 presses the mode setting switch on radio paging receiver 10 to select a function in step 201, and brings radio paging receiver 10 into a storage mode for storing illustration data for displaying an illustration in step 202. The user also presses another switch (not shown) to enter the number of an illustration to be displayed on display unit 1 in step 203. Then, the user presses a pushbutton in pushbutton group 22 of infrared remote control unit 20, which corresponds to an illustration code signal assigned to an illustrating function required to display an illustration indicated by the entered numbers whereupon light-emitting unit 21 transmits an infrared transmission signal S1 for sending the illustration code signal for displaying the indicated illustration. The infrared transmission signal S1 transmitted to radio paging receiver 10, is processed by light-detecting unit 5, and demodulated by demodulator 4 into a code signal, which is sent to control unit 2 in step 204. Control unit 2 compares the code signal with the illustration code signals stored in memory 3 in step 205.

If the received code signal agrees with any one of the illustration code signals stored in memory 3 (YES in step 205), then control unit 2 sends the code signal to display unit 1 which displays an illustration on display screen 11 according to the illustrating function corresponding to the illustration code signal in steps 206–210. Specifically, when the code signal "001" is sent to display unit 1, display unit 1 moves the display dot 11*a* one dot downward in step 206. When the code signal "010" is sent to display unit 1, display unit 1 moves the display dot 11*a* one dot upward in step 207. When the code signal "011" is sent to display unit 1, display unit 1 moves the display dot 11*a* one dot to the right in step 208. When the code signal "100" is sent to display unit 1, display unit 1 moves the display dot 11*a* one dot to the left in step 209. When the code signal "101" is sent to the display unit 1, display unit 1 reverses the display dot 11*a* between black and white in step 210. If the received code signal does not agree with any one of the illustration code signals stored in memory 3 (NO in the step 205), then control goes back to step 204. When the display of an illustration according to the illustrating function in any one of the steps 206–210 is finished, control unit 2 stores the illustration data of the displayed illustration according to a bit map form in an illustration data storage area of memory 3 in step 211.

If the illustration indicated by the number is unfinished and its display is to be continued (NO in step 212), then the user transmits an infrared transmission signal S1 from infrared remote control unit 20 again in step S204. If the display of the illustration indicated is finished (YES in the step 212), then the user presses the mode setting switch to finish the storage mode for storing the illustration data for the illustration indicated.

The illustration code signals and the illustration data which have been stored in memory 3 according to the operation sequences shown in FIGS. 2 and 3 can be erased from memory 3 when the user presses the mode setting switch to select an "illustration data erasure mode" and carries out predetermined operations After the illustration data have been stored, when radio paging receiver 10 receives a radio paging signal having its own paging number which includes an illustration display request signal, then control unit 2 decodes the number of an illustration included in the illustration display request signal, successively reads illustration data corresponding to the numbered illustrations from the illustration data storage area of memory 3, and sends the illustration data to display unit 1 to display the illustration on the display screen 11.

Although a preferred embodiment of the present invention has been described using specific terms, such description is for illustrative purposes only, and it is to be understood that changes and variations may be made without departing from the spirit or scope of the following claims.

What is claimed is:

1. A radio paging receiver having an illustration display function in the form of a dot matrix on a display screen based on illustration data stored in memory means for displaying illustrations, comprising:

infrared signal receiving and demodulating means for receiving and demodulating an infrared signal which includes a plurality of code signals from an infrared remote control unit, and control means for assigning the code signals sent from the infrared remote control unit to various illustrating functions, and after storing the code signals into said memory means, receiving and demodulating an infrared signal from the infrared remote control unit which includes a series of code signals corresponding to the illustrating functions to display a certain illustration, displaying the certain illustration on the display screen according to the illustrating functions to which the series of code signals have been assigned, and storing the illustration data of the displayed illustration into said memory means.

2. A method of controlling a radio paging receiver having an illustration display function in the form of a dot matrix on a display screen based on illustration data stored in a memory means for displaying illustrations, said method comprising the steps of;

receiving and demodulating an infrared signal which includes code signals from an infrared remote control unit, assigning the code signals to various illustrating functions, storing the code signals into said memory means receiving and demodulating an infrared signal which includes a series of code signals corresponding to the illustrating functions to display a certain illustration from the infrared remote control unit, displaying the certain illustration on the display screen according to the illustrating functions to which the series of code signals have been assigned, and storing the illustration data of the displayed illustration into said memory means.

3. A method of controlling a radio paging receiver according to claim 2, wherein, when a code signal assigned to one of the illustrating functions is stored in said memory means, receiving the same infrared signal transmitted again from the infrared remote control unit, and confirming whether the reproduced code signal agrees with the code signal stored.

4. A method of controlling a radio paging receiver according to claim 2, wherein storing said illustration data according to a bit map form.

* * * * *